United States Patent [19]

Tsuzuki et al.

[11] 4,205,322

[45] May 27, 1980

[54] ELECTROSTATIC METHOD OF SIMULTANEOUSLY TRANSFERRING TO A RECORDING MEDIUM A TONER IMAGE HAVING DIFFERENT POLARITIES

[75] Inventors: Mitsuo Tsuzuki; Michihisa Suga, both of Tokyo, Japan

[73] Assignee: Nippon Electric Co., Ltd., Tokyo, Japan

[21] Appl. No.: 955,716

[22] Filed: Oct. 30, 1978

Related U.S. Application Data

[63] Continuation of Ser. No. 790,875, Apr. 26, 1977.

[30] Foreign Application Priority Data

Apr. 27, 1976 [JP] Japan ..... 51/49097

[51] Int. Cl.[2] ..... G03G 15/044

[52] U.S. Cl. ..... 346/153; 346/157

[58] Field of Search ..... 346/157, 153, 165; 101/DIG. 13

[56] References Cited

U.S. PATENT DOCUMENTS

| | | | |
|---|---|---|---|
| 3,045,644 | 7/1962 | Scwertz | 346/157 |
| 3,305,872 | 2/1967 | Fyler | 346/157 |
| 3,392,667 | 7/1968 | Cassel | 346/157 |
| 3,702,483 | 11/1972 | Fantuzzo | 346/157 |

OTHER PUBLICATIONS

Electronics, vol. 50, #5, pp. 3, 4, 3/77, (McGraw Hill Inc.), "Printer Operates with 2 Colors".

*Primary Examiner*—John H. Wolff

*Attorney, Agent, or Firm*—Hopgood, Calimafde, Kalil, Blaustein & Lieberman

[57] ABSTRACT

The invention contemplates electrostatic recording apparatus in which a toner image consisting of toner particles of at least two different kinds and of different polarities is efficiently and reliably transferred to a recording medium, such as an ordinary sheet of paper. The toner particles having different polarities are all converted into those having one polarity, and after such conversion the toner image (with its two kinds of particles) is electrostatically transferred to the recording medium, the transfer involving both kinds of particles at the same time. Various embodiments are described.

12 Claims, 6 Drawing Figures

ELECTROSTATIC METHOD OF SIMULTANEOUSLY TRANSFERRING TO A RECORDING MEDIUM A TONER IMAGE HAVING DIFFERENT POLARITIES

This is a continuation of copending application Ser. No. 790,875, filed Apr. 26, 1977.

BACKGROUND OF THE INVENTION

1. Field of the Invention

This invention generally relates to electrostatic recording, and particularly to a method of electrostatically transferring to a recording medium, in a single operation, a toner image consisting of toner particles having different polarities.

2. Description of the Prior Art

At the present time, various types of recording apparatus are required in the field of business machines and computers. In such recording apparatus, contents to be recorded may be classified into fixed-type information having fixed content such as forms, and variable-type information as may be presented by different characters, numerals and the like. An example of distinguishing between fixed-type information and variable-type information is to employ colors. Many attempts have been proposed for recording colors according to the type of contents. Of course, colors can be used not only to distinguish the mentioned types of contents but also to distinguish other information. In such electrostatic recording methods as employ electrophotography, or multiple styli, or an electrode having a pattern contour, an image is developed on a latent image retentive medium with two kinds of toner particles having different polarities and colors, thereby providing two kinds of recording information in a discriminatable manner. Illustratively, such electrostatic recording may involve formation of a latent image having different polarities on an electrostatic sheet serving as a latent image retentive medium, this latent image being then developed with toner particles having different polarities and colors. With this illustrative prior art method, a satisfactory two-color toner image may be obtained on a latent image retentive medium.

However, the indicated prior art lacks ability to simultanteously transfer an image consisting of two different kinds of toners having positive and negative polarities, from the electrostatic latent image retentive medium, onto a recording medium such as ordinary paper. For this reason, it has been a common practice in recording an image to fix a toner image on a costly latent image retentive medium, and then to use the medium as the recording sheet.

Xerography and the PIP method are among prior art methods for two-color recording. According to these methods, a latent electrostatic image having one polarity, either positive or negative, is first subjected to development of one color toner, transfer to a recording medium, and fixing; and thereafter a latent image of another polarity is subjected to a similar procedure, using another color toner. Such two-color recording, however, dictates an expenditure of time twice as long as that required for a method for one color recording and hence is not adaptable to high-speed recording.

A transfer method is also part of the prior art for two-color recording. In this method, a latent electrostatic image having two polarities is subjected to development by two color toners, and a recording medium is superposed on a toner image having two polarities. Then, a conductive roller is contacted to the back surface of the recording medium, and A.C. voltage is applied between the conductive roller and a latent image retentive medium on which a toner image is positioned. However, such a method is low in efficiency and the transferred toner image on the recording medium is uneven, because when the polarity of A.C. voltage becomes the same polarity as the toners of the toner image, these toners cannot be transferred to the recording medium.

SUMMARY OF THE INVENTION

It is accordingly an object of the present invention to provide an electrostatic recording apparatus in which a toner image consisting of toner particles of at least two different kinds and different polarities can be transferred to a recording medium efficiently and reliably.

It is another object of the present invention to provide a method of transferring a toner image consisting of toner particles of at least two kinds and different polarities to an ordinary paper as the recording medium.

According to the present invention, toner particles of two different kinds and different polarities are transferred to a recording medium through the steps of developing a latent image on a latent image retentive medium, using toner particles of at least two kinds and of different polarities to form a toner image, charging the toner image to one polarity, applying to the toner image a recording medium charged to said one polarity, and separating the recording medium from the latent image retentive medium while subjecting the toner image to an electric field that is charged in the poled direction to attract the toner image to the recording medium.

According to the present invention, toner particles having different polarities are all converted into those having one polarity, so that a toner image consisting of at least two kinds of toner particles may be efficiently, simultaneously and electrostatically transferred to the recording medium. Moreover, the toner image transferred to the recording medium is even and uniform.

According to another of its aspects, the present invention provides a method of transferring a toner image consisting of toner particles of at least two kinds and of different polarities, which method comprises the steps of charging to one polarity a toner image which has already been formed by developing a latent image on a latent image retentive medium with toner particles of at least two kinds of different polarities, superposing on the toner image a recording medium which has been charged to said one polarity, subjecting the back surface of the recording medium to corona-charging, and separating the recording medium from the latent image retentive medium, while holding the electrodes at fixed potential and so as to urge the recording medium with light pressure against the latent image retentive medium. Corona-charging is applied from the back surface of the recording medium beforehand, so that high-speed transfer becomes possible irrespective of the relaxation time of a particular recording medium. On the other hand, the recording medium can be separated from the latent image retentive medium by employing an electrode which contacts the back surface of the recording medium, at such potential that the recording medium can be separated from the latent image retentive medium without gaseous discharge.

Specifically, the present invention permits high-speed and efficient transfer of a toner image consisting of toner particles of at least two kinds onto an ordinary paper having high resistivity, ranging from about $10^{11}$ to $10^{14}$ Ω.cm.

DESCRIPTION OF THE PREFERRED EMBODIMENTS

Figure 1:
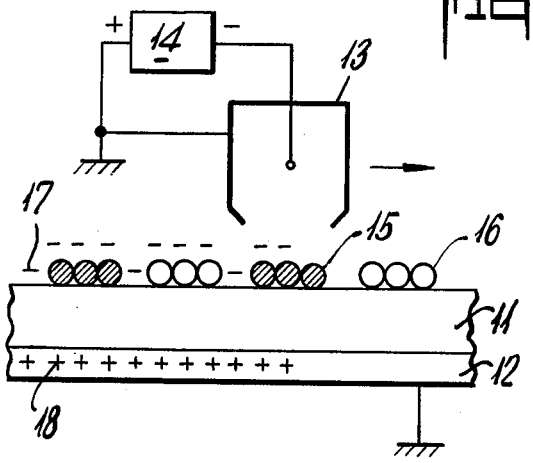
FIG. 1 is a diagrammatic view illustrative of one example of a process of charging toner particles to one polarity according to the invention.

FIG. 1 shows an example of a method of converting a toner image of two different polarities to a toner image of one polarity according to this invention. Shown at 11 is a latent image retentive medium, which is an insulating material such as polyethylene telephthalate, FEP (Fluorinated ethylene-propylene-copolymer) or the like, or a photoconductive material such as selenium or the like. Formed on the back surface of the latent image retentive medium 11 is an electrode 12 which is grounded. Formed on the surface of the latent image retentive medium 11 is a toner image consisting of negative toner particles 15 and positive toner particles 16, which toner image is formed by developing positive and negative latent image components according to known techniques. For example, the negative toner particles 15 may be black-colored particles while the positive toner particles 16 may be red-colored particles, or vice versa. When the negative toner particles 15 and positive toner particles 16 are negatively corona-charged by a corona charger 13 connected to a power source 14, both the negative toner particles 15 and the positive toner particles 16 exhibit a negative polarity.

Figure 2:
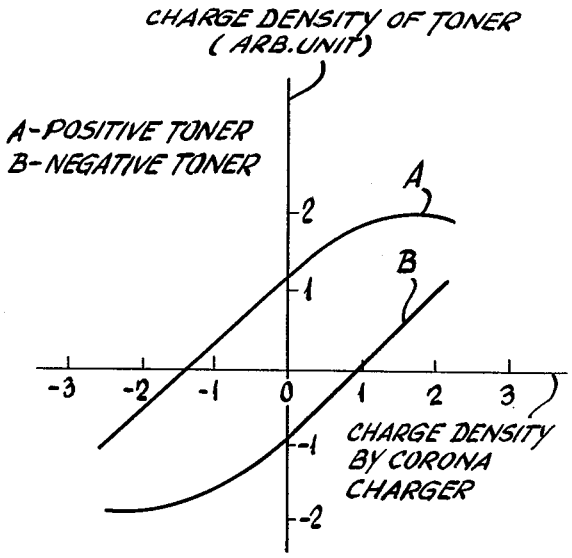
FIG. 2 is a characteristic graph of typical corona charging for positive and negative toner particles.

FIG. 2 shows plotted measurements of typical corona-charging characteristics of positive and negative toner particles. As shown in FIG. 2, a negative charge level of the negative toner particles is raised by negative corona-charging, while a positive charge level of the positive toner particles is lowered; eventually, the polarity of the positive toner particles changes from positive to negative. As the level of negative corona charge is further increased, the negative charge level of the negative toner particles is raised to some extent, although it does not exhibit marked change, for the situation depicted in FIG. 2. Still further, should positive corona-charging be applied to negative toner particles, then the initial negative polarity of the particles may be changed to positive polarity. In this manner, corona-charging can be seen to convert to one polarity the different polarities of the various toner particles.

Returning to FIG. 1, and due to negative corona-charging, a positive charge 18 is induced at the back electrode 12, which is shown grounded; the level of charge 18 is commensurate with the level of negative charge 17 (corona-induced), and therefore both the positive toner particles 16 (which have been corona-charged to a negative polarity) and the negative toner particles 15 are attracted to the surface of the latent image retentive medium 11, due to electrostatic attracting force existing between the negative electrostatic image at 17 and the positive charge at 18. It has been confirmed that positive and negative toner particles, as at 15 and 16, do not become detached from the electrostatic latent image retentive medium 11, even after negative corona-charging has been applied.

Description has been given of the case of negative corona-charging. However, it will be understood that similar principles apply to use of positive corona-charging. In such case, both the negative toner particles 15 and the positive toner particles 16 exhibit a positive polarity.

To achieve an efficient transfer, it is necessary that the level of the corona charge be twice as high as that of the original charge of the toner particles whose polarity is to be changed by the corona charge. As a result, the absolute charge level of the particles undergoing polarity reversal becomes equal to that of the original polarity. In general, a charge level of general type toner particles is 5 μcoulomb/g or more, and the amount of toner to be attached after development is 0.5 mg/cm$^2$ or more, so that the level of a charge per unit area of a toner image on the latent image retentive medium 11 is generally $2.5\times10^{-9}$ coulomb/cm$^2$ or more. Thus, the corona-charge level should be $0.5\times10^{-8}$ coulomb/cm$^2$ or more.

The corona-charge level has been favorably determined to be less than $10^{-6}$ coulomb/cm$^2$ for achieving a stable transfer, e.g., when a recording medium is separated from a latent image retentive medium. In particular, such a corona-charge level avoids gaseous discharge attributable to corona-charging. More specifically, the recording medium closely contacts the latent image retentive medium at a spacing of 1 to 10 μm, as indicated by actual measurement. With such spacing, a gaseous discharge will start at about 350 V. If the back surface of the recording medium is grounded, the voltage across both media is given as $V=Q/(C_A+C_G)$, wherein $C_A$ represents capacitance of the latent image retentive medium, and $C_G$ represents capacitance of the spacing between the recording medium and the latent image retentive medium. Thus, if the level Q of the corona charge is maintained below $10^{-6}$ coulomb/cm$^2$, then V will be necessarily less than 350 V.

Figure 3:
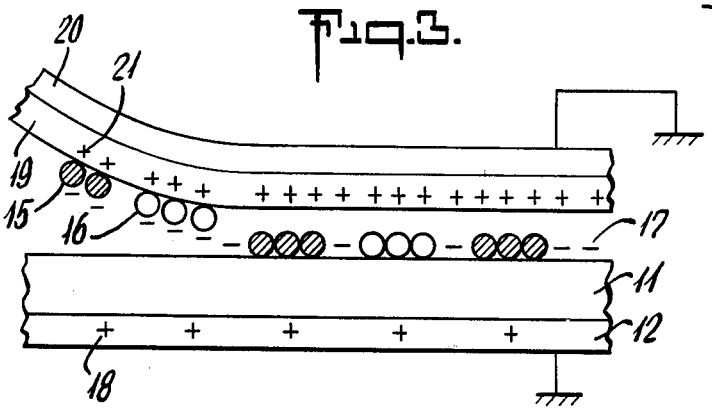
FIGS. 3 and 4 are diagrammatic views illustrative of examples of a process of transferring toner particles to a recording medium according to the invention.

FIG. 3 is a diagrammatic view illustrative of a first example of the subsequent step of (a) applying a recording medium 19 to a toner image which has already been charged to one polarity, by the step shown in FIG. 1; and (b) transferring the toner image 15, 16 to the recording medium 19. In FIG. 3, the toner particles 15 and 16 on the latent image retentive medium 11 will be understood to have already been converted to all-negative polarity, due to the action of the corona charger 13 of FIG. 1. The example of FIG. 3 will also be understood to illustrate the case in which the recording medium 19 is an electrically conductive material, the recording medium 19 and an electrode 20 connected to ground potential being presented to the surface of the latent image retentive medium 11. In this circumstance, a positive charge 21 is induced in the recording medium 19 due to the negative charge 17 created by corona charging, while the level of the charge 18 induced to the grounded electrode 12 is lowered. The ratio of charge on electrode 12 to charge on the recording medium 19 depends on electrostatic capacity between toner particles 15, 16, and the two electrodes. As the electrostatic capacitance between toner particles (15, 16) and the electrode 20 is larger than the electrostatic capacitance between toner particles (15, 16) and the electrode 12, the negatively charged toner particles (15, 16) are more strongly attracted to the recording medium 19. Accordingly, the closer the toner particles (15, 16) and the recording medium 19 come toward contact with each other, greater the amount of toners transferred. When the recording medium 19 is separated from the latent image retentive medium 11, and while the recording medium 19 is still in contact with electrode 20, the two different toner particles 15 and 16 are simultaneously transferred to the recording medium 19.

Figure 4:
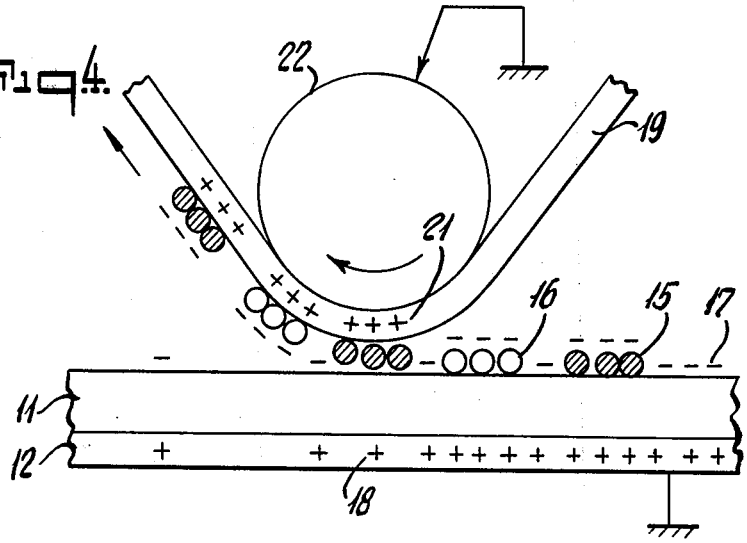

FIG. 4 is a diagrammatic view illustrative of another example of the step of superposing a recording medium 19 on a toner image and transferring the toner image to a recording medium 19. This example features use of an electrically conductive roller 22 as a backing electrode for the recording medium 19, to enable high-speed transfer. As in the example of FIG. 3, the two different kinds of toner particles 15 and 16 have already been negatively charged by a corona charger or the like. And again, in FIG. 3, an electrically conductive material is used for the recording medium, although an insulating material may also be used. The recording medium 19 is pressed against the latent image retentive medium 11 by means of the electrically conductive roller 22, shown grounded. As in the former example, a positive charge 21 is established at the surface of the recording medium 19, while the level of the charge 18 induced to the grounded electrode 12 is lowered, so that the negatively charged toner particles 15, 16 are attracted to the recording medium 19. The recording medium 19 is separated from the latent image retentive medium 11 as the roller 22 rotates, and while toner particles 15, 16 are transferred to the recording medium 19.

According to another example of the step of transferring the toner image to the recording medium, a bias voltage, instead of the ground potential, is applied to the electrode 20 shown in FIG. 3. When a bias voltage of polarity opposite to that of charge 17 (which is the result of corona-charging the positive and negative toner particles 15, 16) is applied to the electrode 20 shown in FIG. 3, the level of charge 21 induced to the surface of the recording medium 19 is raised, as compared with that of a charge of the former examples, thus providing a larger force to act on the toner particles 15, 16. Should an insulating material or a paper of a low electrical conductivity be used as the recording medium 19, effective transfer results by applying such a bias voltage. However, when the bias voltage is excessively applied, gaseous discharge can occur in any air gap between the recording medium 19 and toner particles 15, 16, thus leading to uneven transfer or distortion in the transferred toner image. For this reason, any bias voltage should be selected for magnitude not to cause such gaseous discharge. What has been said for the use of a bias voltage at electrode 20 of FIG. 3 will be understood also to apply to the roller 22 in FIG. 4, the same result being obtained.

Before the recording medium 19 shown in FIG. 3 or FIG. 4 is superposed on the latent image retentive medium 11, the surface of the recording medium 19 which contacts a toner image may be corona-charged. The polarity of this corona charge is opposite to that of a charge 17. By such pre-charging of the recording medium, any insulating material or paper of low electric conductivity which is capable of supporting a charge, can be successfully used as the recording medium 19. When the recording medium 19 which has been charged positively is superposed on toner particles (15, 16) which have been negatively charged (by the corona charger 13 of FIG. 1 on the surface of the latent image retentive medium 11), then the toner particles 15, 16 can be readily transferred to the recording medium 19.

A combination of pre-charging the recording medium 19 with the application of a bias voltage to its back electrode 20 (22) enables further improved transfer.

A toner image which consists of positive and negative toner particles, and such as that which may be transferred according to the method as given in the mentioned examples, may be formed according to latent electrostatic image-forming and developing techniques which will now be referred to and described.

Among the various known techniques that may be used as for forming an electrostatic image with charges of different polarity on the surface of a latent image retentive medium is an induction-image forming method proposed by C. F. Carlson in U.S. Pat. No. 2,297,691. Alternatively, the method proposed by L. E. Walkup in U.S. Pat. Nos. 2,825,814 and 2,833,648 may be utilized. Further, a multi-stylus electrode may be used; for example, two independent rows of multi-stylus electrodes may be positioned in opposed relation to a latent image retentive medium as of dielectric film, with positive and negative voltages applied between two independent rows of multi-stylus electrodes and a backing electrode for use with the latent image retentive medium, thereby forming positive and negative electrostatic latent images. Still further, the so-called PIP method may be used, wherein the latent electrostatic image is formed using a multi-stylus electrode and a latent image retentive medium characterized by durable internal polarization; more specifically, a positive latent image may be formed on an insulating layer at the surface of a photo-conductor member according to the PIP method, and thereafter a negative latent image may be formed using a multi-stylus electrode. Furthermore, it has been proposed to combine the PIP method with the charge transfer method of L. E. Walkup, whereby a positive latent image is first formed on the insulating layer on a photo-conductive layer according to the PIP method, and then a transparent electrode is superposed on an insulating layer; a bias voltage is then applied between the transparent electrode and the photo-conductive layer to provide negative polarity at the transparent electrode, during exposure of image light, thereby forming a negative latent image on the insulating layer.

The development of electrostatic latent images having different polarities on a latent image retentive medium may also be effected by simultaneous development of two colors, using a developer which comprises a mixture of toner particles which have been positively and negatively charged.

Another method involves separate development of two colors, with positive and negative latent images being developed separately, using a first developer consisting of positively-charged toner particles and a second developer consisting of negatively-charged toner particles.

Should a latent electrostatic image of single polarity be developed with toner particles of a single polarity, then density of toner image is increased along the edges of a latent electrostatic image region, thus failing to provide uniform development. To avoid this result, the electric field must be increased in the space above the image area, and for this purpose, it is known to use a so-called development electrode. However, the use of toner particles which have been charged positively and negatively enables uniform development without need for a development electrode. Therefore, recording apparatus employing the transfer method of this invention enables uniform development for either a two-color image or a one-color image.

Figure 5:
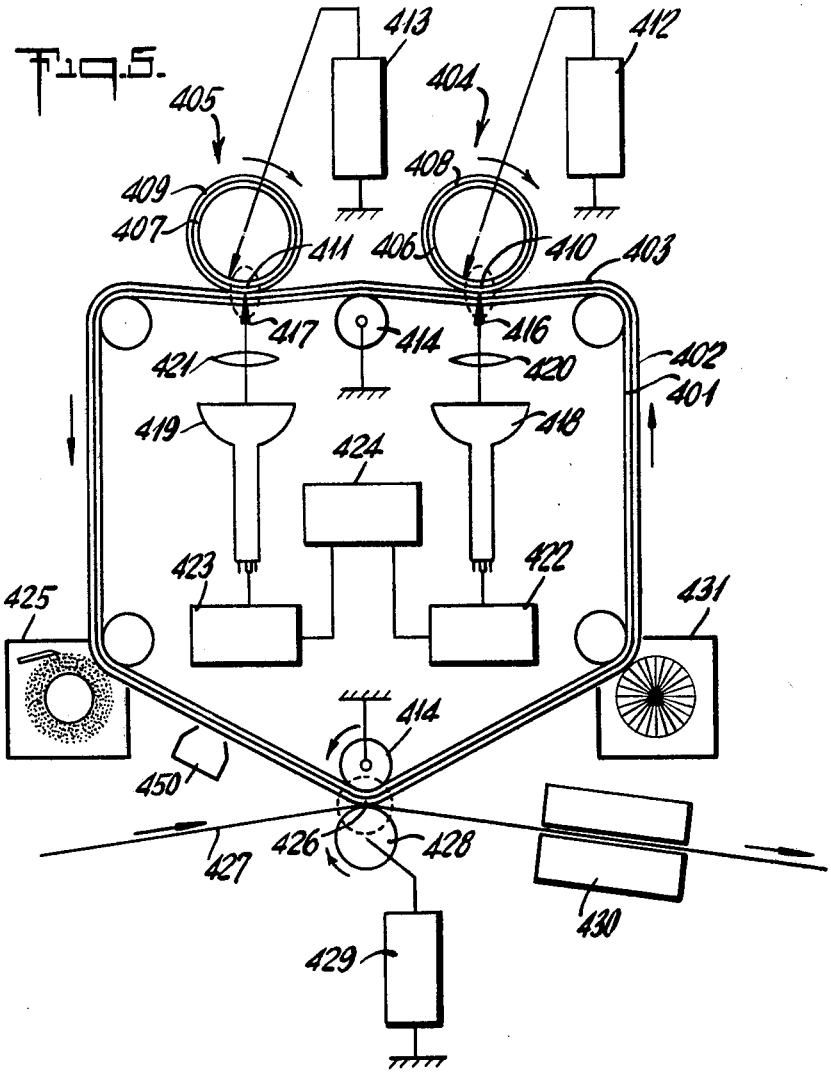
FIG. 5 diagrammatically shows an embodiment of a two color recording apparatus of the invention, in which another example of a process of transferring toner particles to a recording medium is represented.

FIG. 5 shows still another example of transferring to a recording medium a toner image which has been charged to one polarity by a corona-charging portion. In this example, a transparent latent image retentive medium 402 having a transparent electrically conductive layer 401 on its back surface is used, while transfer of a toner image to a recording medium 427 is carried out by using a grounded electrically conductive roller 414 and a transfer electrode roller 428. Use of the electrically conductive roller 414 enables use of a latent image retentive medium 402 in the form of an endless tape; it also enables efficient high-speed continuous recording. In addition, two cylindrical photosensitive members 404 and 405 are maintained in contact with the surface 403 of the latent image retentive medium 402. The recording device of FIG. 5 will be seen to enable two-color recording. The cylindrical photosensitive members 404 and 405 are provided in the form cylindrical electrically conductive members 406 and 407 having photo-conductive layers 408 and 409 on their respective outer surfaces. In operation, and as suggested by arrows 416, 417 in the drawing, a ray of optical information is incident upon the photo-conductive layers 408 and 409 via the transparent electrically conductive layer 401 of transparent latent image retentive medium 402. And means for applying an electric field, means for exposing an optical image, and means for controlling exposure are provided as follows: Voltage sources 412,413 are connected to apply electric fields across the series-related combination of the insulating latent-image retentive medium 402, and photo-conductive layers 408 (and 409) through their respective contacting portions 410 (411); thus voltage sources 412, 413 are applied across the insulating latent-image retentive medium 402 (grounded on one side by layer 401), and the cylindrical photosensitive members 404, 405, the excitation voltage being maintained by electric contact with the cylindrical electrically conductive members 406, 407. Accordingly, a latent image having two polarities is formed by applying positive and negative voltages, at 412, 413, respectively. The transparent electrically conductive layer 401 on the back surface of the transparent latent image retentive medium 402 is in continuous contact with the supporting conductive roller 414, thereby maintaining layer 401 at a zero potential or at a potential approximating zero. Optical exposure is provided illustratively by optical information on the respective faces of cathode ray tubes 418, 419, and is then focused through optical lenses 420, 421 on the photo-conductive layers 408, 409, respectively. Meanwhile, electric signals to be fed to an indicating circuit 423 are delayed, as compared with corresponding electric signals to be fed to an indicating circuit 422, by means of a delay circuit 424. By setting this delay time to match the travel time of the transparent latent image retentive medium 402, from the contacting portion 410 to the contacting portion 411, two latent electrostatic images corresponding to two contemporaneous components of optical information may be recorded, in superposed relation, on the same recording surface of the transparent latent image retentive medium 402. The optical system of FIG. 5 is simplified, by provision of the single optical lenses 420, 421. A latent electrostatic image formed on the surface of the latent image retentive medium 402 is developed for visibility at a station 425, for example by applying two different toners of different colors and different polarities to the latent image retentive medium 402.

As shown in FIG. 5, two-color, two-polarity toner particles are converted into toner particles of single polarity at a corona-charging station 450, being then transferred to a recording medium 427 at a transfer station 426. At the same time, at station 426, a voltage is applied from a power source 429 to a roller 428 serving as a transfer electrode, whereby the toner image is electrostatically transferred from medium 402 to the surface of the recording medium 427. The toner image which has been transferred to the recording medium 427 may be thermally fixed in a fixing station 430 just prior to external delivery; alternatively, the transferred toner image on medium 427 may be fixed according to such other known fixing techniques as by pressure-fixing or the like, and then delivered outside. On the other hand, the transparent latent image retentive medium 402, from which the toner image has been transferred, passes through a cleaning station 431 to remove any toner remaining on its surface before recycled use in the formation of another latent electrostatic image.

It is thus seen that the latent image retentive medium of FIG. 5 is composed of a transparent electrically conductive layer and a transparent insulating recording medium, in the form of an endless tape, while electrodes which contact the latent image retentive medium and the recording medium are provided in the form of rollers. The construction of FIG. 5 is an effective two-color electro-photographic recording device.

Figure 6:
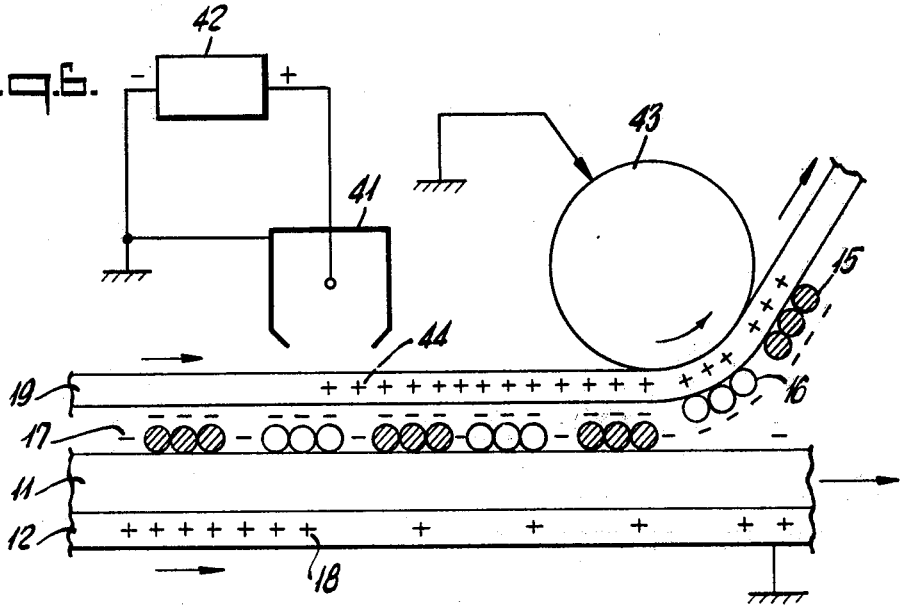
FIG. 6 is a diagrammatic view showing still another example of a process of transferring toner particles on a recording medium according to the invention.

FIG. 6 is a diagrammatic view illustrative of a still further example of the step of superposing a recording medium on a toner image and of transferring the toner image to the recording medium. This example is particularly effective when ordinary paper is used as the recording medium. Ordinary paper as used herein is defined as a general-purpose paper whose surface is not coated with an insulating material and which has not been subjected to an electrically conductive treatment. The resistivity of such general-purpose paper ranges from about $10^{11}$ to $10^{14}$ Ω.cm and varies over a wide range, depending on temperature and moisture. The arrangement of FIG. 6 enables transfer of a toner image to paper having resistivity as high as the above values or to paper having resistivity lower than the above values.

In the example of FIG. 6, ordinary paper of high resistivity is used as the recording medium, taking account of the following facts:

(1) The internal voltage drop in ordinary paper is large and relaxation time is long, so that when transfer speed is increased, there results a reduced difference in voltages to be applied to the toner and to the surface of the recording medium, upon transfer, thus hindering satisfactory transfer. As a result, according to the present invention, corona-charging is applied at 41 to the back surface of a length 19 of ordinary paper, already superposed on the latent image retentive medium 11, thereby imparting a sufficient level of charge in an internal region of the ordinary paper 19. Accordingly, at the time of transfer, the ordinary paper 19 has a uniform potential 44 free of a voltage drop. As a result, even if a high-speed transfer is effected, as at a feed speed of 1 m/sec, there is no possibility of reducing the transfer efficiency.

(2) However, if Item (1) above alone is taken into consideration, namely, when transfer is effected only after corona-charging from the back surface of the ordinary paper, and the ordinary paper is separated from the electrostatic latent image retentive medium 11, then there is provided a high voltage between both of the separating surfaces, such voltage being according to the expression $V=Q_o/C=Q_od/\epsilon$, thus resulting in gaseous discharge; in this expression, $Q_o$ reflects the magnitude of corona charge in accordance with Item (1) above, C represents electrostatic capacitance between the latent image retentive medium and the ordinary paper 19, d represents distance between the respective surfaces, and $\epsilon$ represents the dielectric constant of the air space. Therefore, in this example, an electrode 43 is provided to the back surface of the ordinary paper, and through this electrode 43 the back surface of the ordinary paper 19 is connected to ground potential. In this condition, the voltage between the surface of the ordinary paper and the surface of the latent image retentive medium is given as $V=Q/(C_A+C_G)$, wherein Q represents magnitude of corona charge established by a corona charger 13 as shown in FIG. 1, $C_A$ represents capacitance of the latent image retentive medium, and $C_G$ represents capacitance of the air gap between a recording medium and the latent image retentive medium. Thus, even if the charge on the surface is not dissipated, and corona discharge by a corona charger 13 of FIG. 1 is effected at $10^{-6}$ coulomb/cm$^2$, then there is no possibility of gaseous discharge, upon separation.

(3) For enhancing the effect given by Items (1) and (2) above for a sheet such as ordinary paper having high resistivity, it is advantageous that distance between the ordinary paper and the electrostatic latent image retentive medium be minimized. In other words, if the intervening distance is small, upon transfer, then there may be produced a high electric field required for transfer, even at the same potential. As result, effective transfer may be achieved, even if the level of corona charge by the corona charger 13 of FIG. 1 is low, since the absolute charge level of toner particles undergoing polarity reversal does not become equal to that of the original polarity. In addition, the gaseous discharge would hardly result, because Q in Item (2) above becomes small. For this reason, according to this example, transfer of a toner image and separation of the ordinary paper are effected, with the ordinary paper being urged against the latent image retentive medium by roller means, suggested at 43.

A more complete description will now be given of the example in FIG. 6.

Under the same condition as that of the preceding examples, ordinary paper 19 is superposed on a toner image which has already been charged negatively by the corona charger 13 of FIG. 1, and then the ordinary paper 19 is charged so as to bring its surface potential to ground potential, by means of the corona charger 41 having a polarity opposite to the polarity of the charge 17 applied to positive and negative toner particles 15, 16 (in this example, the polarity of the charger 41 is positive). As shown in the drawing, the ordinary paper 19 becomes charged positively, so that the toner having a negative charge is attracted to the ordinary paper. Thereafter, the ordinary paper 19 is urged against the latent image retentive medium 11 by means of the grounded electrically conductive roller 43, and the ordinary paper 19 is separated from the latent image retentive medium 11, while the ordinary paper 19 remains in contact with the surface of the electrically conductive roller 43, thus transferring the toner particles 15, 16 to the ordinary paper. In this example, it is preferable that the charge potential of the ordinary paper by means of corona charger 41 be the same potential of the ground potential from the viewpoint of transfer. However, the charge potential of the ordinary paper may range as much as ±300 volts with respect to ground potential, while still achieving sufficient transfer efficiency.

In the example of FIG. 6, a grounded roller 43 of simple construction is used to achieve sufficient transfer efficiency by controlling the charge level of the initial charge of toner. However, should the initial charge level effected by corona charger 13 of FIG. 1 be more elevated, as for example due to the charging characteristic of a particular toner, or due to an excessively large amount of dispensed toner, so that voltage across the air space between the surface of the latent image retentive medium including toner and the ordinary paper exceeds a gaseous discharge voltage due to use of a grounded roller, then charge voltage to be impressed on the ordinary paper may be suitably adjusted for desired transfer, or a bias voltage may be applied to the electrically conductive roller 43 so as to maintain voltage across the air space at a level below a gaseous discharge voltage (about 350 V).

In the example of FIG. 6, toner particles have been described as having been previously charged negatively. However, it will be understood that toner particles which have been charged positively beforehand may be similarly transferred.

It is of course possible and favorable that the toner transfer portion 426 of the apparatus shown in FIG. 5 be replaced by the toner-transferring structure of FIG. 6. This will result in efficient high-speed-continuous two-color recording.

We claim:

1. An electrostatic recording apparatus comprising a latent image retentive medium, means for forming a toner image of toner particles having different polarities on said latent image retentive medium, a recording medium, first means for corona-charging said toner image on said latent image retentive medium to one polarity, means for superposing said recording medium on said toner image of one polarity, second means for corona-charging the back surface of said recording medium to superpose an opposite polarity on said toner image of one polarity, and third means for inducing an electric field so that the toner image of one polarity becomes attracted to said recording medium, said third means including a backing electrode having a fixed potential and contacting the back surface of said recording medium, said second means being positioned between said first means and said third means so that a potential which is substantially equal to said fixed potential of said backing electrode may become uniformly distributed within said recording medium before said backing electrode contacts the back surface of said recording medium, whereby a high-speed transfer may be carried out when said recording medium has a high electrical resistivity, and gaseous discharge between said recording medium and said latent image retentive medium may be prevented when said recording medium is separated from said latent image retentive medium.

2. An electrostatic recording apparatus of claim 1, in which the density level of said charging by said first charging means ranges from $0.5\times10^{-8}$ coulomb/cm$^2$ to $10^{-6}$ coulomb/cm$^2$.

3. An electrostatic recording apparatus of claim 1, in which said backing electrode is connected to ground potential.

4. An electrostatic recording apparatus of claim 1, in which said latent image retentive medium is an endless tape and made to move at a fixed speed and said toner image is made of a latent electrostatic image formed on said latent image retentive medium, said apparatus further comprising two cylindrical photosensitive members, one of which serves to form a positive latent electrostatic image and the other serves to form a negative latent electrostatic image, means for rotating said two cylindrical photosensitive members with a surface speed which matches said fixed speed, and two rollers, one of which serves to move said latent image retentive medium, and the other of which serves as said backing electrode contacting the back surface of said recording medium, said electric field being induced by way of said two rollers.

5. The apparatus of claim 1, in which said backing electrode is an electrically conductive roller.

6. Method for high-speed transfer of a toner image on a latent image retentive medium developed with toner particles of different polarities to a recording medium, said method comprising the steps of corona-charging said toner image to convert the same to one polarity, superposing said recording medium on said toner image converted to one polarity, corona-charging the back surface of said recording medium to the opposite polarity, transporting said recording medium with said latent image retentive medium for a sufficient time so that the potential within said recording medium becomes uniformly distributed, and thereafter separating said recording medium from said latent image retentive medium, while contacting a back electrode at fixed potential to the back surface of said recording medium.

7. The method of claim 6, in which the resistivity of said recording medium ranges from $10^{11}$ Ω.cm to $10^{14}$ Ω.cm.

8. The method of claim 6, in which the potential difference between the surface of said latent image retentive medium and the surface of said recording medium superposed on said toner image is maintained below 350 V.

9. The method of claim 6, in which the steps of charging and transporting said recording medium are so regulated as to charge level as to assure that the potential level of said back surface of said recording medium is within 300 V above and below the potential of said back electrode at the time of recording-medium separation.

10. The method of claim 6, in which said back electrode is connected to ground potential.

11. Method for high-speed transfer of a toner image from a latent image retentive medium to a recording medium wherein the toner image to be transferred has been developed on the latent image retentive medium with toner particles of different polarities, said method comprising the steps of corona-charging said toner image to convert the same to one polarity, superposing the recording medium on the polarity-converted toner image, thereafter corona-charging the back surface of the recording medium to the opposite polarity, and thereafter separating the recording medium from the latent image retentive medium while maintaining a fixed-potential contact with the back surface of the recording medium at the region of separation.

12. Method for high-speed transfer of a toner image from a latent image retentive medium to a recording medium wherein the toner image to be transferred has been developed on a latent image retentive medium with toner particles of different polarities, said method comprising the steps of corona-charging said toner image to convert the same to one polarity, superposing the recording medium on the polarity-converted toner image, corona-charging the back surface of the recording medium to the opposite polarity while moving the superposed recording medium and toner image past a corona-charging location, and thereafter separating the thus-charged recording medium from the latent image retentive medium in the course of such movement and at a separating location spaced from the corona-charging location in the direction of movement of the superposed mediums, the separating step being performed while maintaining a fixed-potential contact with the back surface of the recording medium at the location of separation.

* * * * *